United States Patent [19]

Hermann et al.

[11] Patent Number: 5,017,033

[45] Date of Patent: May 21, 1991

[54] METHOD OF PRODUCING A PRINTER WHICH FACILITATES CLEARING A JAMMED DOCUMENT

[75] Inventors: Thomas L. Hermann, Springfield; George J. Eberhardt, Centerville, both of Ohio

[73] Assignee: NCR Corporation, Dayton, Ohio

[21] Appl. No.: 448,389

[22] Filed: Dec. 11, 1987

[51] Int. Cl.[5] ..... B41J 29/02

[52] U.S. Cl. ..... 400/693; 400/691; 400/692

[58] Field of Search ..... 400/691-693, 400/207, 208, 248.1, 248.2, 595, 603, 636; 101/479

[56] References Cited

U.S. PATENT DOCUMENTS

| | | | |
|---|---|---|---|
| 4,510,345 | 4/1985 | Costa et al. | 400/693 |
| 4,531,852 | 7/1985 | Madge et al. | 400/692 |
| 4,549,825 | 10/1985 | Fish et al. | 400/692 |
| 4,773,772 | 9/1988 | Hanna et al. | 400/58 |
| 4,778,291 | 10/1988 | Mitsuhashi | 400/121 |
| 4,795,282 | 1/1989 | Bradam | 400/605 |
| 4,810,118 | 3/1989 | Hauger et al. | 400/212 |
| 4,827,282 | 5/1989 | Ritchie | 346/1.1 |

FOREIGN PATENT DOCUMENTS

| | | | |
|---|---|---|---|
| 3509218 | 4/1985 | Fed. Rep. of Germany | 400/692 |
| 164551 | 7/1987 | Japan | 400/692 |

*Primary Examiner*—Clifford D. Crowder
*Assistant Examiner*—Joseph R. Keating
*Attorney, Agent, or Firm*—Wilbert Hawk, Jr.; Albert L. Sessler, Jr.; Elmer Wargo

[57] ABSTRACT

A method of producing a printer so as to effect a low profile for sit/stand operations and to facilitate the removal of a jammed document from a print station in the printer. The printer is formed of a bottom portion and a top portion which are hinged together to enable these portions to be moved from an operative or assembled position and an open position which exposes the print station to facilitate the removal of a jammed document. The bottom portion has an overall height which is small relative to the overall height of the top portion so as to make the printer conducive to sit/stand operations. Latches are used to detachably latch the bottom and the top portions in the assembled and open positions mentioned.

10 Claims, 6 Drawing Sheets

10
12
14
16
DOCUMENT PATH 24
24-1
30
30-1
30-2
30-3
32
34
36
38
40
42
46
48
50
52
58
58-1
58-2
60
62
64
66
68
70
72
96
102
104
112
116
130
132

METHOD OF PRODUCING A PRINTER WHICH FACILITATES CLEARING A JAMMED DOCUMENT

BACKGROUND OF THE INVENTION

1. Field of the Invention

This invention relates to a method of producing a printer so as to effect a low profile for sit/stand operations and also to facilitate the removal of a jammed document from a print station in the printer.

2. Background Information

In recent years, there has been a trend towards making business machines more compact and more versatile. Making the machines more compact tends to complicate matters as far as removing a document which may become jammed at a print station within a business machine, like a printer, for example. Changing ribbons or ribbon cassettes used in printers also tends to be cumbersome.

A recent trend in making business machines more versatile relates to make them conducive to being used by an operator when the operator is standing or sitting at the machine. Some prior art business machines have too high a profile for use in such sit/stand operations.

SUMMARY OF THE INVENTION

The present invention obviates the problems mentioned in that a printer made according to this invention has a low profile which is conducive to sit/stand operations.

The present invention also produces a printer which facilitates the removal of a document which is jammed at the associated print station of the printer. Changing inked ribbon cassettes is also facilitated by the design of the printer of this invention.

In a preferred embodiment of this invention there is provided a method of producing a printer so as to effect a low profile for sit/stand operations by an operator using said printer and also to facilitate the removal of a jammed document from a print station in said printer, comprising the steps:

(a) forming a bottom portion and a top portion of a housing for said printer so that said print station and a document path leading to said print station lie between the bottom and top portions when the top portion is positioned over the bottom portion in assembled relationship therewith;

(b) providing a pivot for the bottom and top portions to enable the top portion to be pivoted from the assembled relationship mentioned in step (a) to an opened position which exposes said print station and said document path to facilitate removing said jammed document;

(c) forming said bottom portion so that its overall height is small in relation to the overall height of said top portion; however, the overall height of the bottom portion is made substantially small to make it conducive for sit/stand operations and for housing pinch rollers associated with a document feed mechanism associated with said printer;

(d) locating drive rollers associated with said feed mechanism in said top portion so that said drive rollers are in operative relationship with said pinch rollers when said top and bottom portions are in said assembled relationship to enable said feed mechanism to feed a document to said print station;

(e) locating a printing mechanism including a print head in said top portion so that said print head is in operative relationship with said print station when said top and bottom portions are in said assembled relationship;

(f) locating a platen associated with said printing mechanism in said bottom portion;

(g) providing a moveable panel on said top portion to enable an operator to gain access to the interior of said top portion and said printing mechanism; and (h) providing latching means for detachably latching said bottom and top portions in said assembled relationship and said opened position.

In another aspect of the invention, there is provided a printer comprising:

a bottom portion and a top portion which form a housing for said printer when in an assembled relationship, said printer having a print station and a document path leading to said print station which lie between said first and second portions when said first and second portions are in said assembled relationship;

a feed mechanism including pinch rollers and drive rollers for feeding a document along along said document path to said print station when said bottom and top portions are in said assembled relationship;

said feed rollers being mounted in said bottom portion, said bottom portion having an overall height which is substantially small compared to the overall height of said top portion;

said drive rollers being mounted in said top portion so that said drive rollers are in operative relationship with said pinch rollers when said bottom and top portions are in said assembled relationship to enable said feed mechanism to feed a document to said print station;

a printing mechanism including a print head mounted in said top portion so that said print head is in operative relationship with said print station when said bottom and top portions are in said assembled relationship;

hinge means for pivotally joining said bottom and top portions together to enable said top portion to be pivoted between said assembled relationship and an opened position which exposes said print station and said document path;

said top portion having a moveable panel to enable an operator to gain access to the interior of said top portion and said printing mechanism; and latching means for detachably latching said bottom and top portions in said assembled relationship and said opened position.

These advantages and others will be more readily understood in connection with the following description, claims, and drawing.

BRIEF DESCRIPTION OF THE DRAWINGS

FIG. 3 is taken from the direction of arrow A of FIG. 1.

DESCRIPTION OF THE PREFERRED EMBODIMENT

Figure 1:
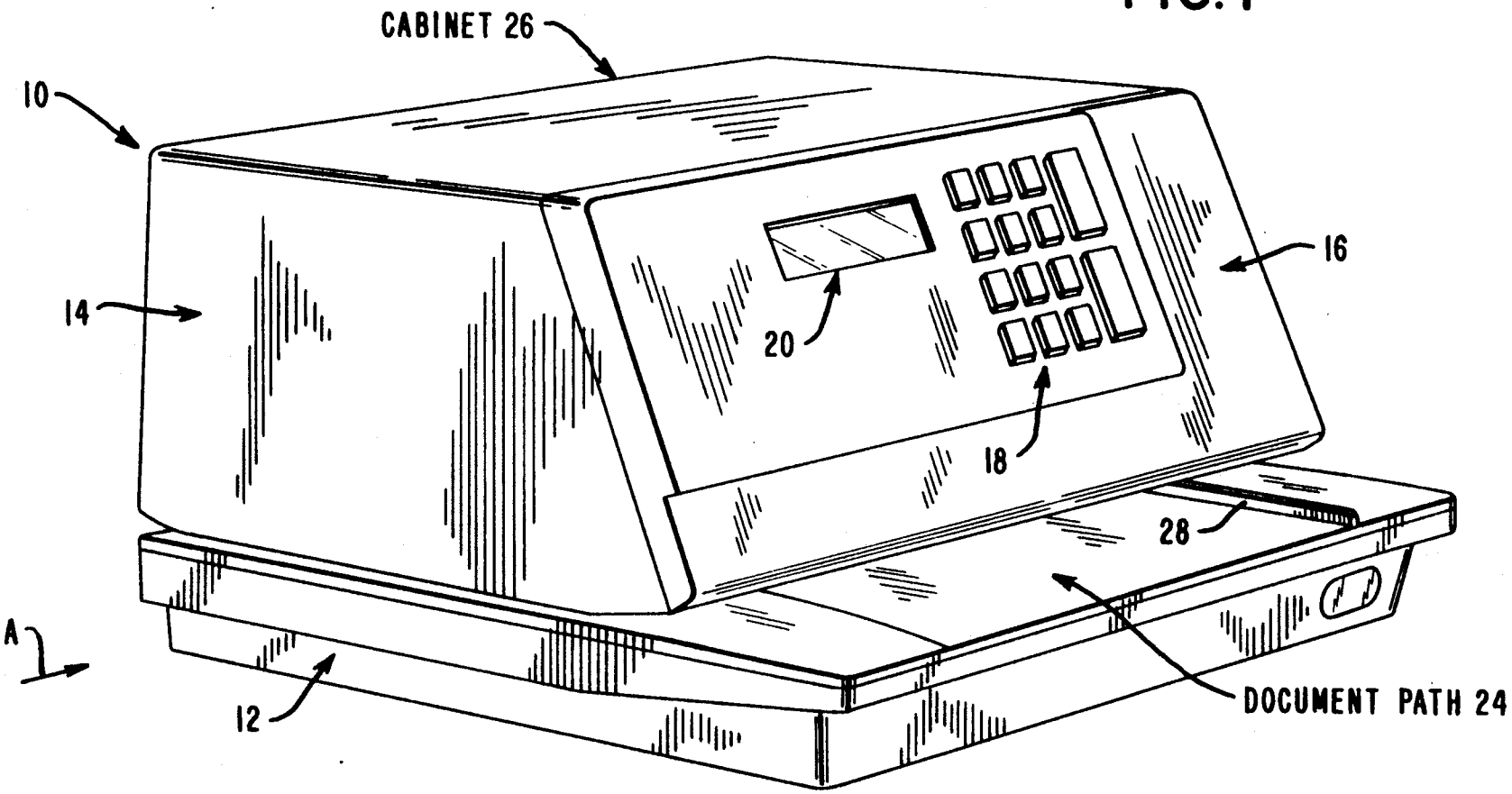
FIG. 1 is a general perspective view of a preferred embodiment of this invention showing a printer having a bottom portion and a top portion, with these bottom and top portions being shown in the normal operating or assembled relationship.

As stated earlier herein, one of the aims of producing the printer was to design a printer so as to effect a low profile for sit/stand operations. In this regard, when an operator using the machine stands or sits at certain times during the processing of documents at a bank, for example, it is desirable to provide a bottom half of the printer having an overall height which is very small. FIG. 1 shows a printer 10 which is made according to the method of this invention.

The printer 10 includes a bottom portion 12 and a top portion 14 which are shown in the normal operating or assembled position in FIG. 1. The top portion 14 of the printer 10 also includes a panel 16 which includes a keyboard 18 and a display 20.

A first step in producing the printer 10 is to design it so that the associated print station 22 (FIG. 2) and a document path 24 (FIG. 1) leading to the print station 22 lie between the bottom portion 12 and the top portion 14 of the printer cabinet 26. The document path 24 has a guide rail 28 which provides a means for aligning a document as it is moved towards the print station 22.

Figure 2:
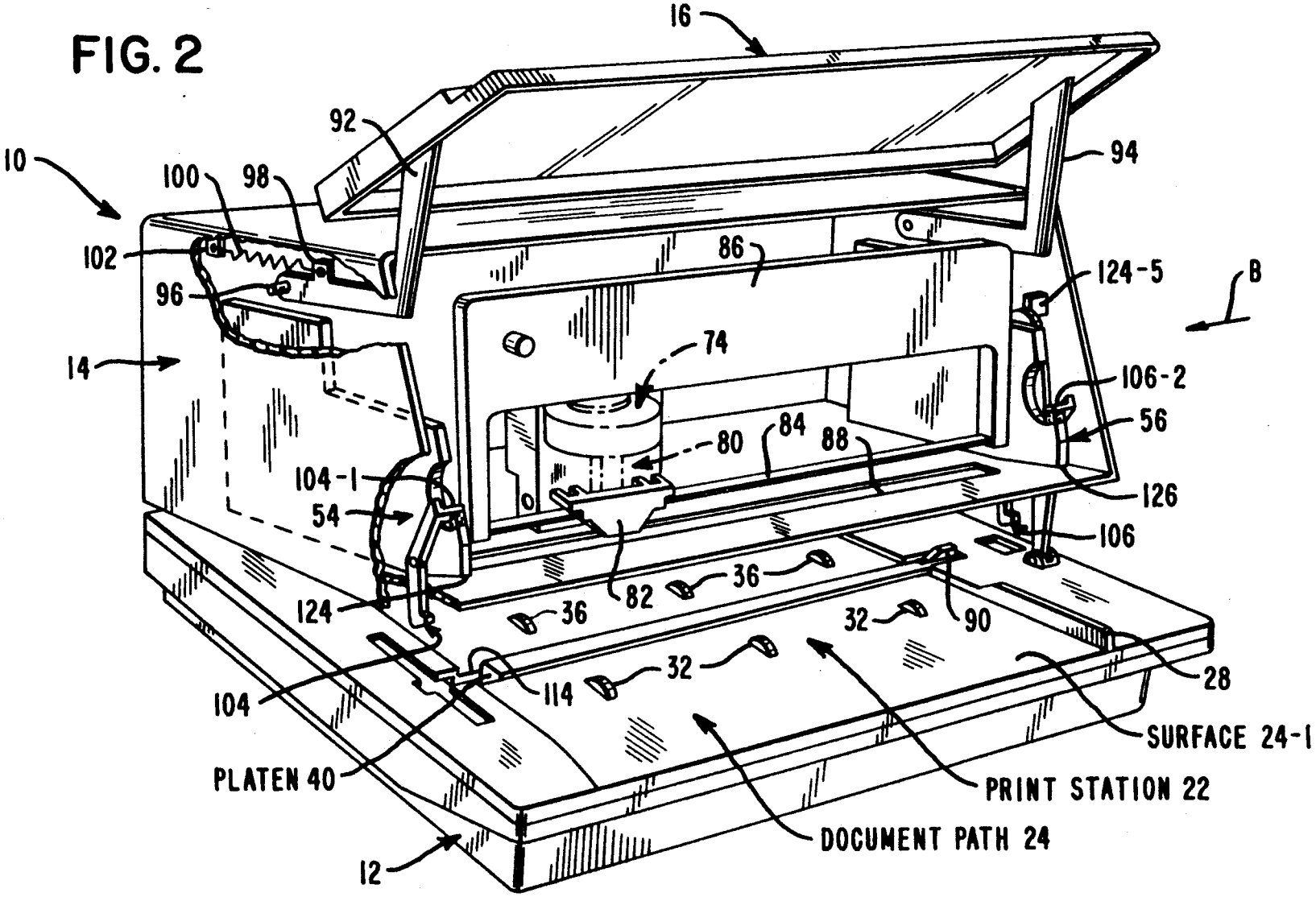
FIG. 2 is a general perspective view of the printer shown in FIG. 1, with the top portion of the printer being pivoted from the assembled relationship with the bottom portion shown in FIG. 1 to an opened position which exposes a print station in the printer and which also facilitates the removal of a jammed document from the print station.

The next step in producing the printer 10 is to provide a pivot 30 for the bottom and top portions 12 and 14 of the cabinet 26 so as to enable the top portion 14 to be pivoted from the assembled position shown in FIG. 1 to the opened position shown in FIG. 2. In the opened position, the print station 22 is exposed, permitting a jammed document (not shown) which may be stuck at the print station 22 to be removed. The pivot 30 is conventional, and it includes a pair of upright portions 30-1, extending upwardly from the bottom portion 12, with only one upright portion 30-1 shown in FIG. 3. The top portion 14 has a rod 30-2 mounted therein, with the rod 30-2 being supported in the pair of upright portions 30-1. Each of the upright portions 30-1 also has a slotted circular recess 30-3 therein to enable the rod 30-2 to be mounted therein as is conventionally done.

Figure 3:
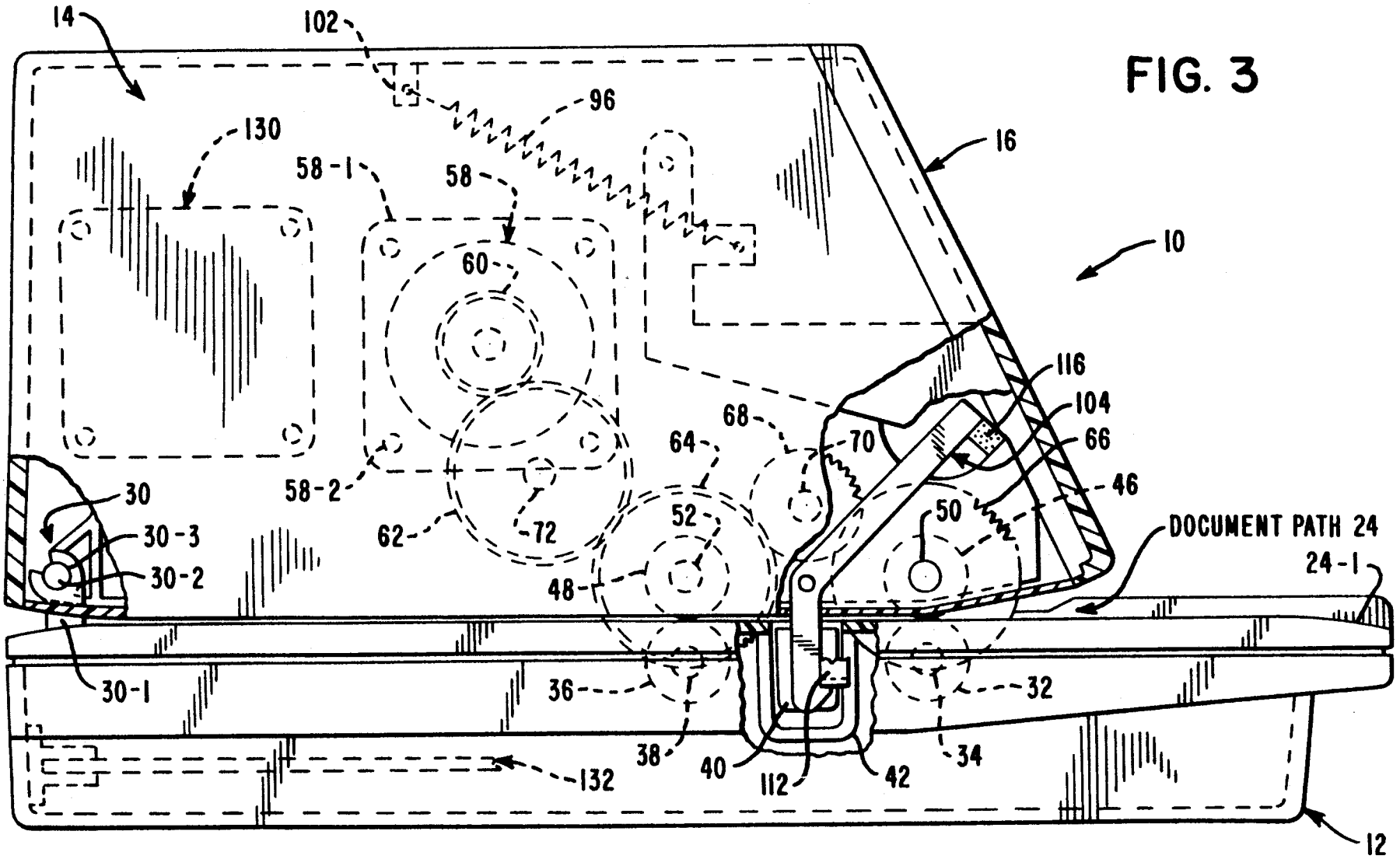
FIG. 3 is a side view, in elevation, of the printer shown in FIGS. 1 and 2, and it shows the pivoting means to enable the top portion to be moved to the position shown in FIG. 2.

Another feature of this invention is that the bottom portion 12 is made as small as it can be so as to make the printer 10 adaptable for sit/stand operations as previously discussed. As seen in FIG. 3, which is drawn substantially to scale, the overall height of the bottom portion 12 is small compared to the overall height of the top portion 14, and the absolute overall height of the bottom portion 12 is less than two inches in the embodiment described. Having the bottom portion 12 small as described facilitates using the printer 10 when an operator sits down to use the printer.

Figure 4:
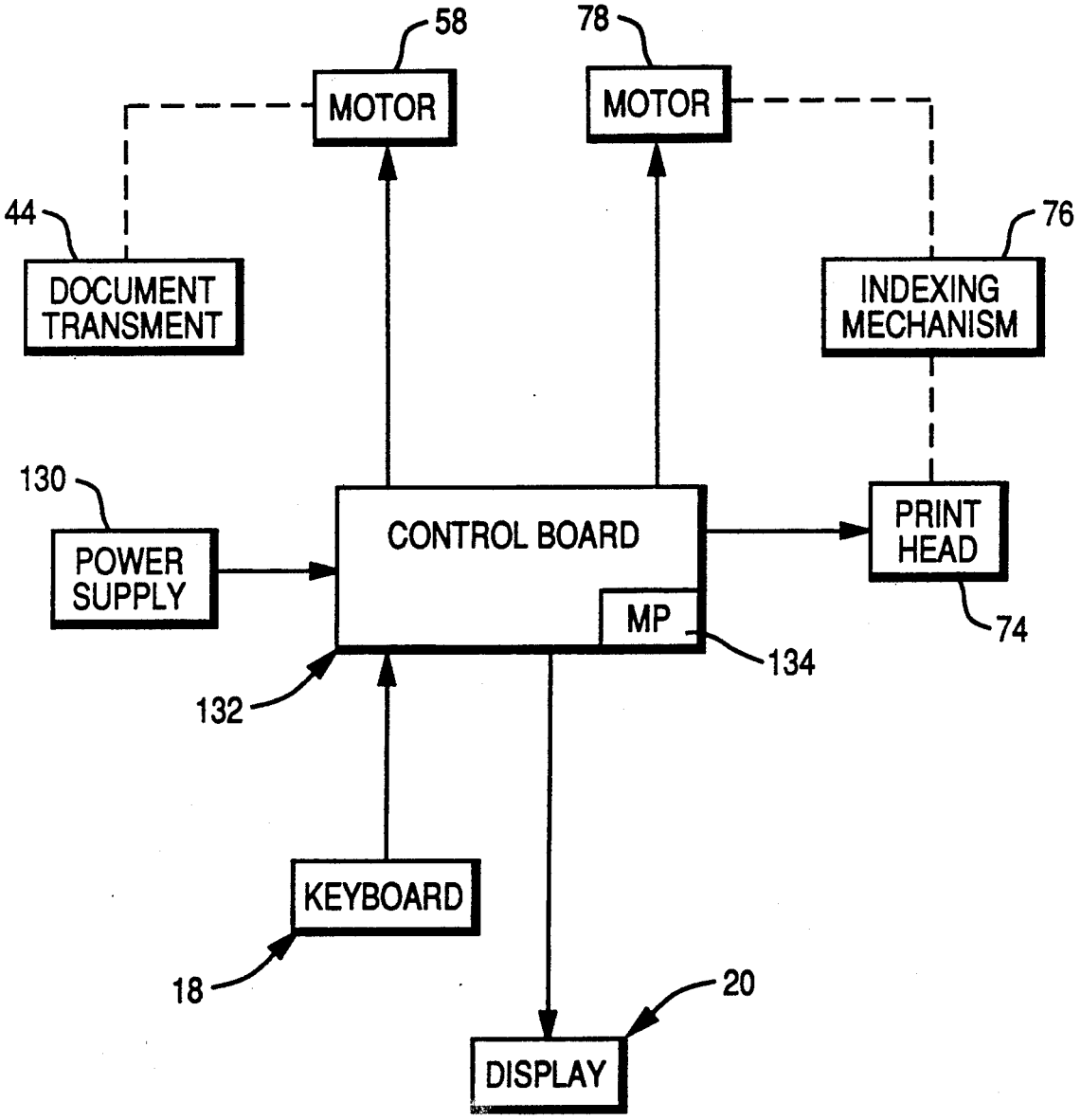
FIG. 4 is a schematic diagram, in block form, of a control board and various other elements for controlling the operation of the printer shown in FIG. 1.

The bottom portion 12 houses a first bank of pinch rollers 32 which are rotatably mounted on a rod 34 (FIG. 3) and also houses a second bank of pinch rollers 36 which are rotatably mounted on a rod 38. The first bank of pinch rollers 32 is mounted on one side of the print station 22 as shown in FIG. 2, and the second bank of pinch rollers 36 is mounted on the other side of the print station 22. A rectangularly shaped platen 40 is mounted between the first and second banks of pinch rollers 32 and 36 as shown best in FIG. 2. The first and second banks of pinch rollers 32 and 36 and the platen 40 are conventionally biased upwardly as shown in FIG. 3 by suitable springs (not shown). The platen 40 is mounted in a generally "U"-shaped member 42 (FIG. 3) which extends along the length of the platen 40. The first and second banks of pinch rollers 32 and 36, just described, are part of a conventional document transport 44, shown schematically in FIG. 4.

Another step in the method of producing the printer 10 relates to locating drive rollers associated with the document transport 44 in the top portion 14 of the printer 10. When the top portion 14 is above the bottom portion 12 in the assembled position shown in FIG. 3, for example, the drive rollers of the document transport 14 are in operative relationship with the first and second banks of pinch rollers 36 and 38. In this regard, the drive rollers of the document transport 44 include a first bank of drive rollers 46 and a second bank of drive rollers 48 which are aligned with the first and second banks of pinch rollers 32 and 36, respectively, as shown in FIG. 3. The first bank of drive rollers 46 is mounted on a shaft 50, and correspondingly, the second bank of drive rollers 48 is mounted on a shaft 52. The shafts 50 and 52 are mounted in the side frames 54 and 56 which are shown in diagrammatic form in FIG. 2.

The document transport 44 also includes a bidirectional motor 58 (FIG. 3) which is used to power the first and second banks of drive rollers 46 and 48 to drive a document towards and away from the print station 22. The motor 58 has an output gear 60 which drives or rotates an intermediate gear 62, which in turn, rotates a gear 64 which is fixed to the shaft 52 to rotate it and the drive rollers 48 mounted thereon. A drive gear 66 is similarly fixed to the shaft 50 to rotate it and the first bank of drive rollers 46 fixed to the shaft 50. A gear 68, in mesh with both the gears 64 and 66, is used to rotate gear 66 in the same direction as gear 66 is rotated to drive or rotate the first and second banks of drive rollers 46 and 48 in the same direction. The gear 68 is mounted on a rod 70, and the intermediate gear 62 is also mounted on a rod 72. The rods 70 and 72 are mounted between the side frames 54 and 56. The flange 58-1 of the motor 58 is secured to the side frame 54 by suitable fasteners 58-2. Because the document transport means 44 just described is conventional, it need not be described in any further detail.

Another step in producing the printer 10 according to this invention is to locate the printing mechanism in the top portion 14. This printing mechanism includes a print head 74, an indexing mechanism 76 (FIG. 4) to move the print head 74 along the length of the platen 40, and a motor 78 to power the indexing mechanism 76. The indexing mechanism 76 is conventional and includes a carriage 80 and traversing screw (not shown) which are used to move the print head 74 along the length of the platen 40 Because this aspect is conventional, it need not be described in any further detail.

The print head also includes a ribbon bracket 82 which attaches to the lower end (as viewed in FIG. 2) of the print head 74 and guides a ribbon 84 from the ribbon cassette 86 around the printing end of the printer 74. One of the features of this invention is that when the top portion 14 of the printer 10 is moved to the open position shown in FIG. 2, replacement of the ribbon cartridge 86 is facilitated. This is because the ribbon bracket 82 is moved away from the platen 40 to enable the ribbon 84 to be handled more freely than when the print head 74 is close to the platen 40 during normal printing when the top and bottom portions 14 and 12 are in the assembled relationship shown in FIG. 2. The top portion 14 also has a slot 88 therein to enable the print head 74 to be positioned close to the platen 40; although, for ease in showing, this slot 88 is shown somewhat closer to the pivot 30 than is actually the case.

Another step in the process of producing the printer 10 is to locate the platen 40 associated with the printer 74 in the bottom portion 12 as previously described. The platen 40 has a ramp portion 90 on the right side of the platen as viewed in FIG. 2. A roller (not shown) on the print head 74 engages the ramp portion 90 when the print head 74 is moved to a home position or the right side of the platen 40 as viewed in FIG. 2. The roller rides up the ramp portion 90 to lower the platen 40 below the surface 24-1 of the document path 24 to enable a document to be moved to the print station 22. The platen 40 is a "free floating" variety so that when the print head 74 moves off the ramp portion 90, platen 40 moves towards the print head 74 to accommodate different thicknesses of documents or media.

Another step in producing the printer 10 is to provide a moveable panel 16 for the top portion 14. This feature also facilitates clearing a document which may be jammed at the print station 22, and it also facilitates changing a ribbon cassette 86, especially when the top portion 14 is in the position shown in FIG. 2. When in this position, the bracket 82 on the end of the print head 74 is spaced from the print station 22, permitting easy access to the ribbon 84.

The moveable panel 16 has generally "L"-shaped arms 92 and 94 extending from the inside of the moveable cover 16 as shown best in FIG. 2. Each arm, like 92, is pivotally mounted on a stud 96 which extends from the interior of the top portion 14 to enable the moveable panel 16 to be pivoted from the closed position shown in FIG. 1 to the opened position shown in FIG. 2. Each arm, like 92, has a projection 98 extending therefrom to which one end of a tension spring 100 is secured, with the remaining end of he spring 100 being secured to a post 102 depending from the top portion 14. The arrangement just described in relation to arms 92 and 94 provides a conventional "over-the-center" linkage to enable the moveable cover to be resiliently held in the open position shown in FIG. 2 and to be resiliently held in the closed position shown in FIG. 1.

Another step in producing the printer 10 is to provide a latching means for detachably latching the bottom and top portions 12 and 14 in the assembled relationship shown in FIG. 1 and the open position shown in FIG. 2. In the embodiment described, there is a first set of latches for detachably holding the top portion 14 and the bottom portion 12 in the assembled position shown in FIG. 1. In this regard, there is a latch 104 located next to the side frame 54, as shown in FIG. 2, and correspondingly, there is a latch 106 located near the side frame 56. The latches 104 and 106 are mirror images of each other, so consequently, only a description of latch 104 need be given.

Figure 5:
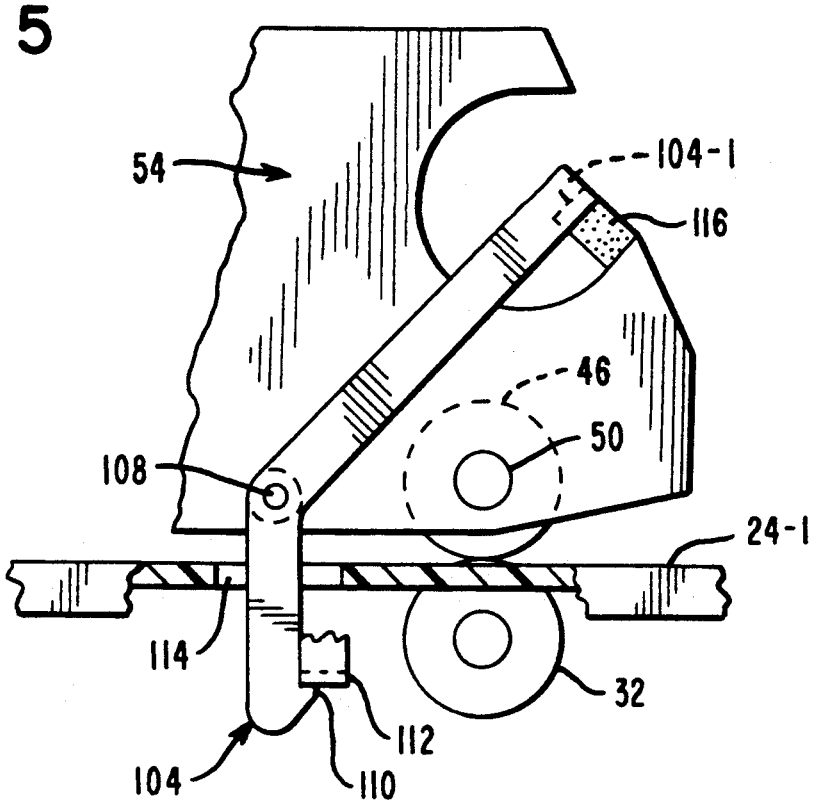
FIG. 5 is is a side view, in elevation, of a latch used for holding the top and bottom portions in the assembled relationship shown in FIG. 1 and is taken from the general direction of arrow A shown in FIG. 1. Certain portions of the printer are removed to facilitate this showing.

The latch member 104 is generally "L"-shaped in outline as shown in FIG. 5. The latch member 104 is pivotally joined to side frame 54 by a suitable means, shown as a pin 108, and it has a shoulder 110 which abuts under a stop 112 located in the bottom portion 12. The lower end of the latch member 104 passes through an opening 114 in the bottom portion 12, and this member is kept in the position shown in FIG. 5 by a resilient pad 116 (secured to the side frame 54) which resiliently biases the member in a counter-clockwise direction as viewed in FIG. 5.

Figure 7:
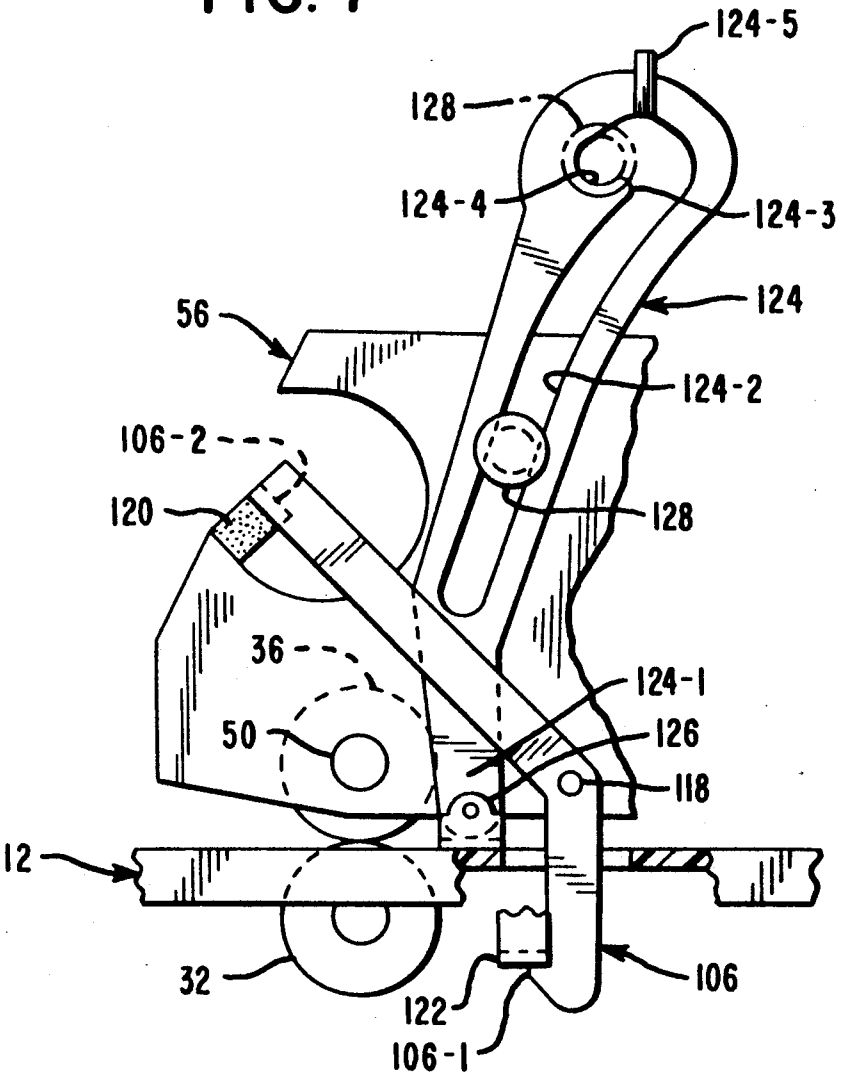
FIG. 7 is a side view, in elevation, of a latch used for holding the top portion of the printer in the open position shown in FIG. 2 and is taken from the direction of arrow B shown in FIG. 2, with certain portions of the top portion being removed to facilitate the showing.

The latch member 106 shown in FIG. 7 is a mirror image of the latch member 104 just described. The latch member 106 is pivotally mounted in the side frame 56 (represented by a pin 118) and is resiliently biased in a clockwise direction (as viewed in FIG. 7) by a resilient pad 120 which is secured to the side frame 56. The lower end 106-1 of the latch member 106 engages a stop 122 in the bottom portion 12, and the upper end 106-2 engages the resilient pad 120.

Figure 6:
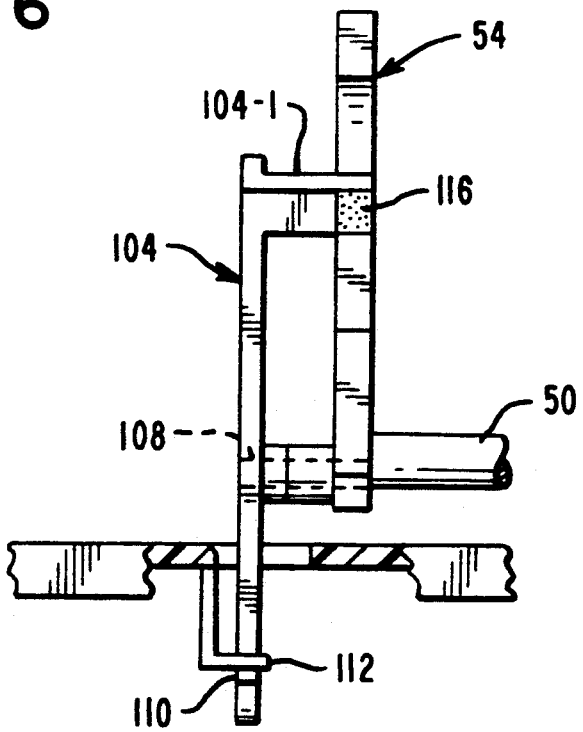
FIG. 6 is an end view, in elevation, of the latch shown in FIG. 5.
Figure 8:
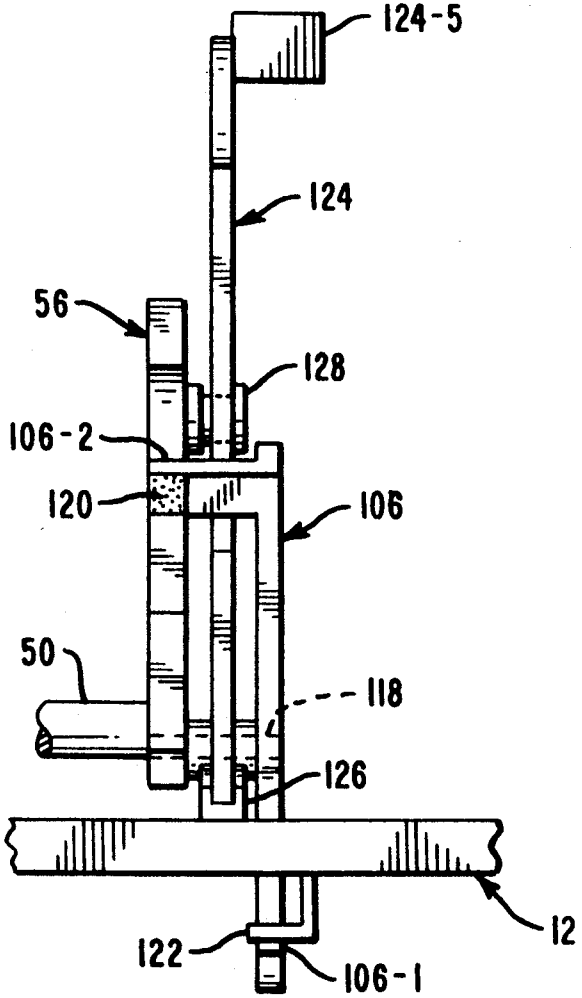
FIG. 8 is and end view, in elevation, of the latch shown in FIG. 7.

In order to unlatch the top portion 14 from the bottom portion 12, an operator moves the pane 16 from the position shown in FIG. 1 to the opened position shown in FIG. 2, exposing the interior of the top portion 14. The operator then places his/her left thumb under the top portion 14 in the area shown by arrow 124 in FIG. 1, and, correspondingly, places the right thumb under the top portion 14 in the area shown by arrow 126. The operator's thumb nails would be contacting the bottom portion 12 at this time. The operator then places the left index finger on the upper end 104-1 (FIG. 6) of the latch lever 104 and compresses the resilient member 116 to thereby rotate the latch lever 104 in a clockwise direction as viewed in FIG. 5. This action releases the lower end or shoulder 110 from the stop 112, permitting the top portion to be raised away from the bottom portion 12. The right index finger of the operator is correspondingly placed on the upper end 106-2 of the latch lever 106 and compresses the resilient member 120 (FIGS. 7 and 8) by moving the right index finger towards the right thumb, thereby rotating the latch lever 106 in a counter-clockwise direction (as viewed in FIG. 7) to release the shoulder 106-1 from the stop 122. When both latches 104 and 106 are released as just described, the top portion 14 may be moved to the position shown in FIG. 2.

As the top portion 14 is moved towards the position shown in FIG. 2, a second latch means comes into play. The second latch means includes a latch 124 (FIGS. 7 and 8) having its lower end 124-1 pivotally joined to a pivot member 126 upstanding from the bottom portion 12. The latch member 124 has an elongated slot 124-2 therein to receive a stud 128 which extends from the side frame 56. The elongated slot 124-2 has a radius of curvature whose origin lies at the center of the pivot 30 (FIG. 3) As the top portion 14 is moved towards the position shown in FIG. 2, the stud 128 rides up the slot 124-2 (as viewed in FIG. 7) until it clears the point 124-3, permitting gravity to pivot the link 124 in a clockwise direction about the pivot member 126. Thereafter, the stud 128 drops into the recess 124-4 to retain the top portion 14 in the position shown in FIG. 2. The location of the stud 128 in the recess 124-4 is shown in dashed outline in FIG. 7.

The upper portion of the latch 124 has a handle 124-5 to facilitate lowering the top portion 14 of the printer 10. To do this, an operator simply raises the top portion 14 slightly, and then pulls the handle 124-5 of the latch 124 towards the front of the printer 10 (a counter-clockwise direction as viewed in FIG. 7) to permit the stud 128 to pass over the point 124-3. Thereafter, the stud 128 rides down the slot 124-2, as viewed in FIG. 7, until the latch members 104 and 106 become latched to the stops 112 and 122 as previously described. The handles 104-1, 106-2, and 124-5 of the various latches just described are colored green according to color coding standards to make such handles visible to an operator when panel is moved to the position shown in FIG. 2. The color green indicates operator controlled elements.

Another feature of this invention is that the power supply 130 (FIG. 3) associated with the printer 10 is located in the top portion 14. Locating the power supply 130 here meant that normal convection cooling techniques could be used to cool the supply 130 instead of having to use a cooling fan when a power supply is located in the bottom portion, like 12, of a printer.

The printer 10 has a control board 132, including a microprocessor (MP) 134 for controlling the operations of the printer 10 as is conventionally done. The control board 132 is located in the bottom portion 12 as seen in FIG. 3 which facilitates having a low profile for the printer 10. The various elements of the printer 10 are conventionally interconnected as shown schematically in FIG. 4. Another advantage of the printer 10 is that its design enables a redesign of the bottom portion 12 to add another printer, like a journal printer, for example, without having to redesign the top portion 14 where most of the elements of the printer reside.

What is claimed is:

1. A method of producing a printer so as to effect a low profile for sit/stand operations by an operator using said printer and also to facilitate the removal of a jammed document from a print station in said printer, comprising the steps:

(a) forming a bottom portion and a top portion of a housing for said printer so that said print station and a document path leading to said print station lie between the bottom and top portions when the top portion is positioned over the bottom portion in assembled relationship therewith;

(b) providing a pivot for the bottom and top portions to enable the top portion to be pivoted from the assembled relationship mentioned in step (a) to an opened position which exposes said print station and said document path to facilitate removing said jammed document;

(c) forming said bottom portion so that its overall height is small in relation to the overall height of said top portion; however, the overall height of the bottom portion is made substantially small to make it conducive for sit/stand operations and for housing pinch rollers associated with a document feed mechanism associated with said printer;

(d) locating drive rollers associated with said feed mechanism in said top portion so that said drive rollers are in operative relationship with said pinch rollers when said top and bottom portions are in said assembled relationship to enable said feed mechanism to feed a document to said print station;

(e) locating a printing mechanism including a print head in said top portion so that said print head is in operative relationship with said print station when said top and bottom portions are in said assembled relationship;

(f) locating a platen associated with said printing mechanism in said bottom portion;

(g) providing a moveable panel on said top portion to enable an operator to gain access to the interior of said top portion and said printing mechanism; and (h) providing latching means for detachably latching said bottom and top portions in said assembled relationship and said opened position.

2. The method as claimed in claim 1 in which said method includes the steps of:

(i) providing a keyboard and a display panel on said moveable panel; and (j) locating in said bottom portion a control board for controlling the operation of said printing mechanism, said keyboard, and said display.

3. The method as claimed in claim 2 in which said forming step (c) is effected by making said overall height of said bottom portion less than 2 inches.

4. A method of producing a printer so as to effect a low profile for sit/stand operations by an operator using said printer and also to facilitate the removal of a jammed document from a print station in said printer, comprising the steps:

(a) forming a bottom portion and a top portion of a housing for said printer so that sad print station and a document path leading to said print station lie between the bottom and top portions when the top portion is positioned over the bottom portion in assembled relationship therewith;

(b) providing a pivot for the bottom and top portions to enable the top portion to be pivoted from the assembled relationship mentioned in step (a) to an opened position which exposes said print station and said document path to facilitate removing said jammed document;

(c) forming said bottom portion so overall height is small in relation to the overall height of said top portion; however, the overall height of the bottom portion is made substantially as small as can be made and still house pinch rollers associated with a document feed mechanism associated with said printer;

(d) locating drive rollers associated with said feed mechanism in said top portion so that said drive rollers are in operative relationship with said pinch rollers when said top and bottom portions are in said assembled relationship to enable said feed mechanism to feed a document to said print station;

(e) locating a printing mechanism including a print head in said top portion so that said print head is in operative relationship with said print station when said top and bottom portions are in said assembled relationship;

(f) locating a platen associated with said printing mechanism in said bottom portion;

(g) providing a moveable panel on said top portion to enable an operator to gain access to the interior of said top portion and said printing mechanism; and (h)providing latching means for detachably latching said bottom and top portions in said assembled relationship and said opened position.

5. The method as claimed in claim 4 in which said method includes the steps of:

(i) providing a keyboard and a display panel on said moveable panel; and (j) locating in said bottom portion a control board for controlling the operation of said printing mechanism, said keyboard, and said display.

6. A printer comprising:

a bottom portion and a top portion which form a housing for said printer when in an assembled relationship, said printer having a print station and a document path leading to said print station which both lie between said bottom and top portions when said bottom and top portions are in said assembled relationship;

a feed mechanism including pinch rollers and drive rollers for feeding a document along said document path to said print station when said bottom and top portions are in said assembled relationship;

said pinch rollers being mounted in said bottom portion, said bottom portion having an overall height which is substantially small compared to the overall height of said top portion;

said drive rollers being mounted in said top portion so that said drive rollers are in operative relationship with said pinch rollers when said bottom and top portions are in said assembled relationships to enable said feed mechanism to feed a document to said print station;

a printing mechanism including a print head mounted in said top portion so that said print head is in operative relationship with said print station when said bottom and top portions are in said assembled relationship;

hinge means for pivotally joining said bottom and top portions together to enable said top portion to be pivoted between said assembled relationship and an opened position which exposes said print station and said document path;

said top portion having a moveable panel to enable an operator to gain access to the interior of said top portion and said printing mechanism; and latching means for detachably latching said bottom and top portions in said assembled relationship and said opened position.

7. The printer as claimed in claim 6 in which said overall height of said bottom portion in substantially as small as it can be and still house said pinch rollers.

8. The printer as claimed in claim 6 in which said overall height of said bottom portion in less than two inches.

9. The printer as claimed in claim 8 in which said moveable panel has a keyboard and a display panel thereon, and in which said bottom portion has a control board therein for controlling the operation of said printing mechanism, keyboard, and display panel.

10. The printer as claimed in claim 6 in which said latching means have operating members which are located in said top portion, and in which said latching means including first latches and a second latch, with said first latches being used to latch said bottom and top portions in said assembled relationship, and said second latch being used to latch said bottom and top portions in said opened position.

* * * * *

UNITED STATES PATENT AND TRADEMARK OFFICE

CERTIFICATE OF CORRECTION

PATENT NO. : 5,017,033

DATED : May 21, 1991

INVENTOR(S) : Thomas L. Hermann et al.

It is certified that error appears in the above-identified patent and that said Letters Patent is hereby corrected as shown below:

On the title page item:
[22] Filed: Delete "Dec. 11, 1987" and substitute --Dec. 11, 1989--.

Column 8, line 30, delete "sad" and substitute --said--.

Column 8, line 41, after the word "so", insert --that its--.

Signed and Sealed this

Twenty-second Day of December, 1992

*Attest:*

DOUGLAS B. COMER

*Attesting Officer*

*Acting Commissioner of Patents and Trademarks*